US005281110A

United States Patent [19]

Dreiman

[11] Patent Number: 5,281,110

[45] Date of Patent: Jan. 25, 1994

[54] HERMETIC COMPRESSOR OIL SEPARATING BAFFLE

[75] Inventor: Nelik I. Dreiman, Tipton, Mich.

[73] Assignee: Tecumseh Products Company, Tecumseh, Mich.

[21] Appl. No.: 62,044

[22] Filed: May 14, 1993

Related U.S. Application Data

[63] Continuation of Ser. No. 801,024, Dec. 2, 1991, abandoned.

[51] Int. Cl.[5] ..... F04B 35/04

[52] U.S. Cl. ..... 417/415; 184/6.16

[58] Field of Search ..... 47/415, 366, 368; 189/6.16, 6.18

[56] References Cited

U.S. PATENT DOCUMENTS

| | | | |
|---|---|---|---|
| 2,752,088 | 6/1956 | Borgerd | 230/58 |
| 3,008,629 | 11/1961 | Gerteis | 417/415 |
| 3,049,285 | 8/1962 | Doeg | 230/206 |
| 3,066,857 | 12/1962 | McCloy | 417/415 |
| 3,279,683 | 10/1966 | Kleinlein | 230/58 |
| 3,465,954 | 9/1969 | Ellis | 417/415 |
| 3,498,530 | 3/1970 | Hover | 417/415 |
| 3,507,198 | 4/1970 | Jensen | 417/415 |
| 3,518,031 | 6/1970 | Randall | 417/415 |
| 3,540,813 | 11/1970 | Murphy | 417/415 |
| 3,817,661 | 6/1974 | Ingalls | 417/312 |
| 4,298,314 | 11/1981 | Thayer | 417/415 |
| 4,470,772 | 9/1984 | Gannaway | 417/368 |
| 4,547,131 | 10/1985 | Riffe | 417/53 |
| 4,834,627 | 5/1989 | Gannaway | 417/415 |

*Primary Examiner*—Richard A. Bertsch
*Assistant Examiner*—Peter Korytnyk
*Attorney, Agent, or Firm*—Baker & Daniels

[57] ABSTRACT

An oil baffle means for sealing and separating the running gear cavity in a hermetic reciprocating piston compressor from an oil sump in a lower part of the compressor housing. The oil baffle includes a L-shaped flange connected to the outboard bearing and crankcase of the compressor. Horizontal ribs and a dimple on the vertical portion of the oil baffle bias the baffle into sealing contact with the crankcase preventing oil from the oil sump to flow into the running gear cavity.

11 Claims, 3 Drawing Sheets

HERMETIC COMPRESSOR OIL SEPARATING BAFFLE

This is a continuation of application Ser. No. 07/801,024, filed Dec. 2, 1991, now abandoned.

BACKGROUND OF THE INVENTION

The present invention relates generally to a hermetic reciprocating piston compressor, and more particularly to such a compressor wherein an oil separation baffle separates the running gear cavity of the compressor from the oil within an oil sump.

Some reciprocating compressors include an open type of crankcase defining a cavity enclosing a crankshaft and crank means communicating with a reciprocating piston. The crank means and piston usually are submerged within the oil sump and mix the oil during compressor operation.

The crank and piston moving with respect to the oil must overcome resistance of the oil in the form of shear stress forces and pressure forces. Shear stress force is the frictional drag due to the viscosity of the oil and the drag of the rotating and reciprocating compressor parts. These forces increase the power consumption of the compressor while sometimes creating a loss of lubrication at compressor start up. This loss of lubrication is caused by oil, within the crankcase, being alternatively drawn into and out of the lower part of the cylinder by the reciprocation of the piston.

In the prior art, the crank means and piston were substantially sealed in a cavity having venting passages. These venting passages were oriented to balance the reaction forces and reduce vibrations of the compressor.

The present invention is directed to overcoming the aforementioned problems related to hermetic reciprocating piston compressors wherein it is desired to provide a simple and cost effective means of separating the running gear from the oil sump within the compressor housing.

SUMMARY OF THE INVENTION

The present invention overcomes the disadvantages of the above described prior art reciprocating compressors by providing a means for separating the running gear from the oil sump into the lower part of the housing.

Generally the invention provides an oil baffle means for use as an oil baffle in a reciprocating compressor to separate the running gear cavity from the oil sump.

In an embodiment of the invention, the oil baffle includes a L-shaped flange having a vertical and horizontal part. The horizontal part attaches to the outboard bearing of the crankshaft submerged in the oil sump. A cavity in the crankcase contains the outboard bearing crankshaft and crank means attached to a reciprocating piston. The vertical portion of the oil baffle substantially seals the running gear cavity from the oil sump while allowing communication of the cavity to the interior housing.

In the preferred form of the invention, the oil baffle includes a biasing means for biasing the vertical part of the oil baffle into engagement with the crankcase. The biasing means comprises at least two stiffening ribs and a dimple to allow the vertical part to tightly engaged the crankcase.

An advantage of the reciprocating compressor of the present invention, according to one form thereof, is that of separating the running gear cavity in the compressor from the oil sump in the lower part of the housing, thereby reducing the power consumption of the compressor.

Another advantage of the reciprocating compressor of the present invention is that the separation of the running gear from the oil sump reduces the possibility of loss of lubrication during start up caused by oil circulation within the running gear cavity.

Yet another advantage of the reciprocating compressor of the present invention is that of lower shear stress forces within the compressor by isolating the moving parts from the oil sump.

A still further advantage of the reciprocating compressor of the present invention is that the piston moves in a substantially intake gas environment caused by the simple, reliable and inexpensive oil baffle means. The oil baffle means separates the pistons from the oil sump.

The invention, in one form thereof, provides a hermetic reciprocating compressor comprising a housing containing an oil sump and a motor connected to a crank means. The crankcase defines a running gear cavity and at least one cylinder with a reciprocating piston therein. The cavity contains a crank means for reciprocating the piston while in communication with the cylinder. Crank means has an outboard bearing located within the oil sump. An oil baffle means attaches to the crankcase and the outboard bearing, to separate the crank means from the oil sump for preventing oil from being repetitively drawn into and from the cylinder.

In one aspect of the previously described form of the invention, the oil baffle means comprises a L-shaped flange having a vertical portion and a horizontal portion and a biasing means. The biasing means urges the vertical portion into engagement with the crankcase. The biasing means comprises at least two stiffening ribs and a dimple so that the vertical portion may be tightly engaged to the crankcase by the spring forces developed by the ribs and dimple. The oil baffle of the present invention creates an oil tight seal with the crankcase and outboard bearing preventing oil from the oil sump from entering the running gear cavity.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
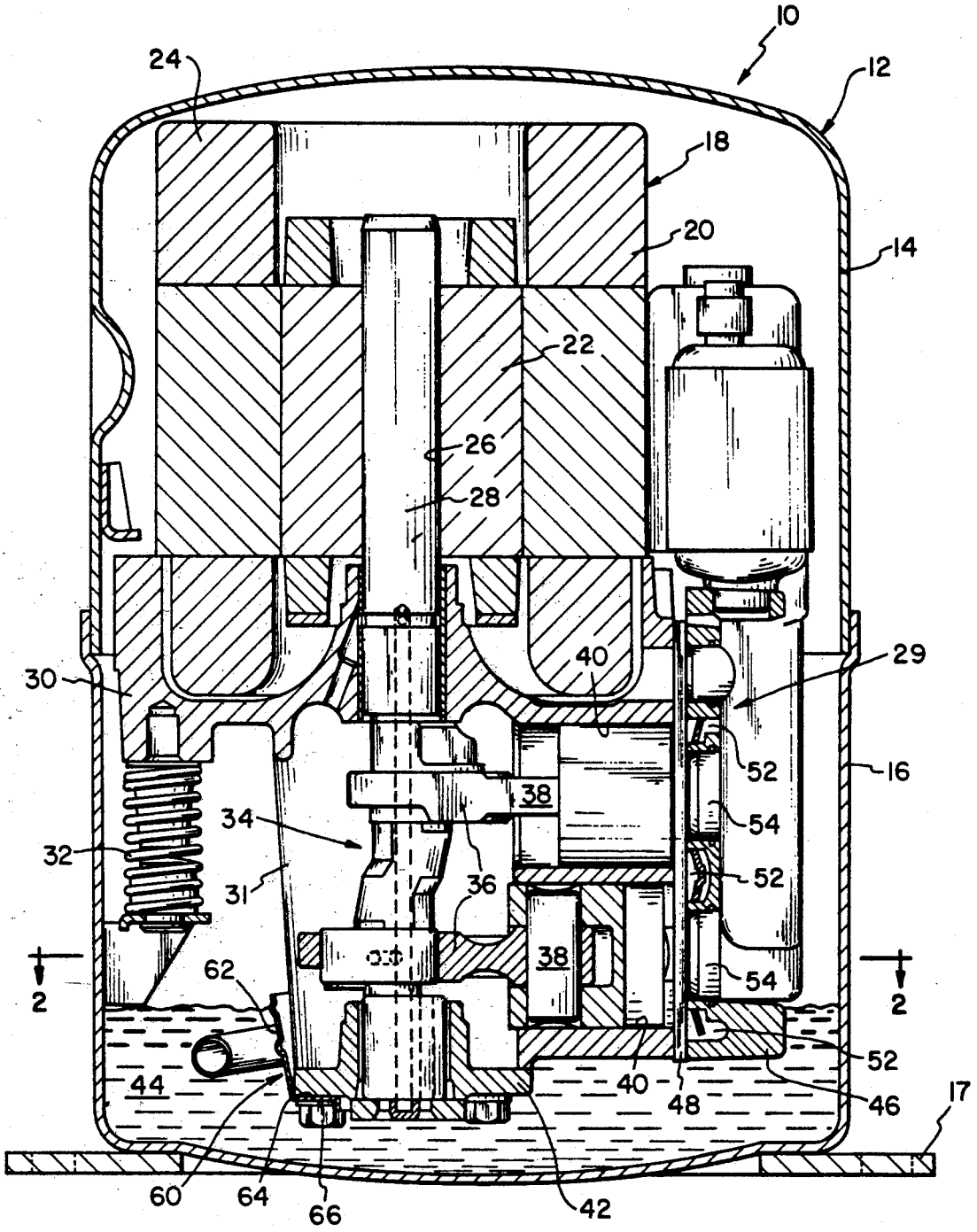
FIG. 1 is a side sectional view of a multiple cylinder reciprocating compressor including an oil baffle according to the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Figure 2:
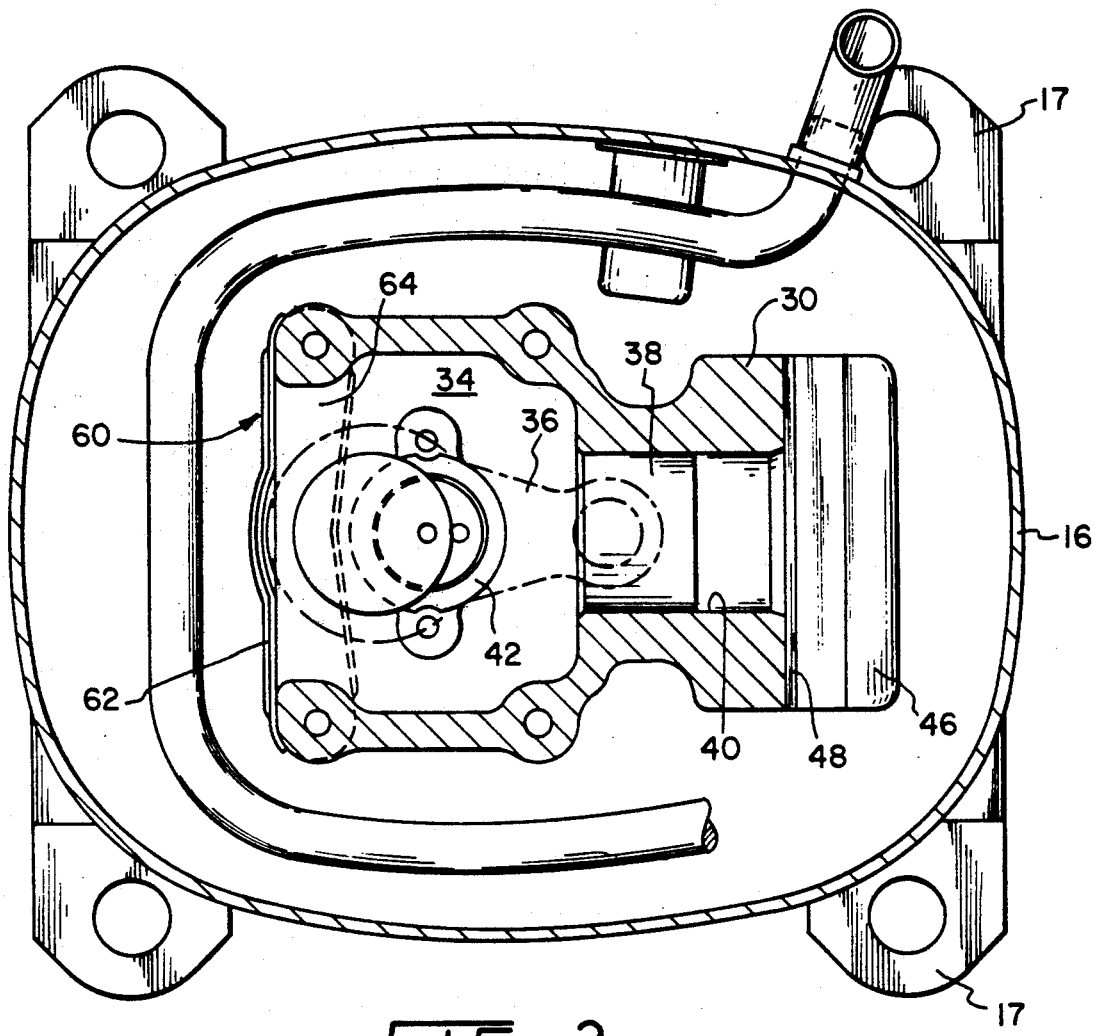
FIG. 2 is a sectional view of the compressor of FIG. 1, taken along the line 2—2 and viewed in the direction of the arrows.

Referring now to FIGS. 1 and 2, there is shown a compressor 10 having a housing generally designated at 12. The housing has a top section 14 and a bottom section 16. The two housing portions are hermetically secured together as by welding or brazing. A mounting bracket 17 is attached to bottom section 16.

Located within hermetically sealed housing 12 is an electric motor generally designated at 18 having a stator 20 and a rotor 22. Stator 20 is provided with winding 24. Rotor 22 has a central aperture 26 provided therein into which is secured a crankshaft 28 by an interference fit. A terminal cluster (not shown) is provided in housing 12 for connecting motor 18 to a source of electrical power.

A compressor unit is shown generally at 29. Disposed within housing 12 is a crankcase 30 supporting crankshaft 28 which is driven by motor 18. Shock mounts 32, attached to crankcase 30 and housing 12, suspend the compressor components within housing 12.

As shown in the illustrated preferred embodiment, crankcase 30 is suspended vertically below motor 18. Crankcase 30 defines a running gear cavity 34 into which crankshaft 28 and other compressor parts are disposed. Crankshaft 28, Within running gear cavity 34 of crankcase 30, drives crank means, such a connecting rods 36 connected to pistons 38, within cylinders 40. Cylinders 40 extend through the top surface of crankcase 30.

A cylinder head 4 is assembled onto the top surface of crankcase 30 by means of bolts (not shown). A valve plate 48, to which discharge valves (not shown) are mounted, is interposed between cylinder head 46 and crankcase 30. Cylinder head 46 includes discharge chambers 52 and suction chambers 54.

Outboard bearing 42 is attached to crankcase 30 and supports the outboard portion of crankshaft 38. Normally, oil sump 44 is above the level of outboard bearing 42 and in contact with a piston 38.

The present invention, in one form thereof, separates running gear cavity 34 from the oil in oil sump 44 to thereby allow pistons 38 to operate in a substantially gaseous environment. Oil separating baffle 60 substantially closes running gear cavity 34 of crankcase 30. Oil baffle 60, in one form, comprises an L-shaped flange having a vertical portion 62 and a horizontal portion 64 (see FIG. 3.). The horizontal portion 64 attaches to outboard bearing 42 of crankshaft 38 by means of bolts 66. Bolts 66 attach through holes 67 in horizontal portion 64. Vertical portion 62 of oil baffle 60 substantially seals running gear cavity 34 from the oil in oil sump 44 while allowing communication of cavity 34 to the interior of housing 12. Vertical portion 62 also contains a window 69. This window 69 is used for initially locating outboard bearing 42 on crankcase 30 during assembly of compressor 10.

Figure 3:
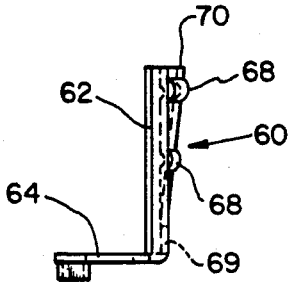
FIG. 3 is a side elevational view of the oil baffle of the present invention.
Figure 4:
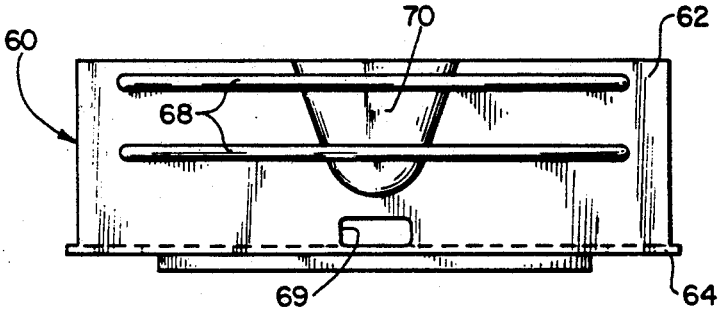
FIG. 4 is a front elevational view of the oil baffle of the present invention.
Figure 5:
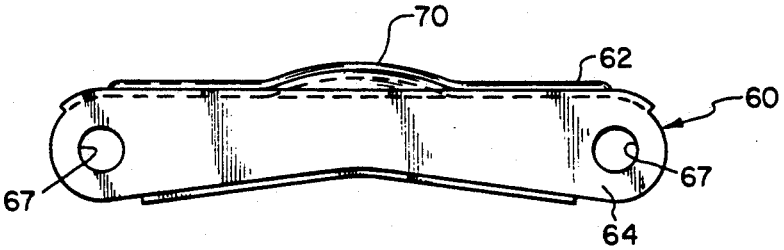
FIG. 5 is a bottom view of the oil baffle of the present invention.

As shown in FIGS. 3-5, oil baffle 60 is preferably formed of sheet metal with horizontal stiffening ribs 68 and dimple 70. The vertical portion 62 of baffle 60 extends to a position above the level of oil in the sump 44 and is tightly fixed against crankcase 30 by forces developed during the attachment of the baffle t the lower part of the outboard bearing 42 by bolts 66. As shown in FIG. 3, vertical portion 62 is perpendicular to horizontal portion 64. Further shown in FIG. 1, leg 31 of crankcase 30 is not perpendicular to the bottom of crankcase 30 or outboard bearing 42 but slopes outward. Forces developed during the attachment of the baffle to the lower part of the upper bearing 42 by bolt 66 create a spring force within a baffle 60 by bending vertical portion 62 out of vertical against leg 31. Baffle 60, when attached to outboard bearing 42, extends to a position above the oil level of oil sump 44. Vertical portion 62 is tightly fixed against crankcase 30 by spring forces developed by ribs 68 and dimple 70. These spring forces help seal running gear cavity 34 from oil sump 44.

In prior twin cylinder, reciprocating piston compressors, the reciprocating motion of pistons 38 tended to mix the oil within the running gear cavity 34 from oil sump 44. Crank means, such as connecting rods 36 and pistons 38 moving with respect to oil had to overcome resistance caused by the frictional drag due to the viscosity of the oil and the drag from the shape of the rotating and reciprocating parts within the oil and running gear 34. An increase in the power consumed by the compressor was the result of this construction.

In accordance with the invention, the running gear cavity 34 is now substantially separate from the oil in oil sump 44 by means of oil baffle 60.

In operation, reciprocation of pistons 38 force oil collected within running gear cavity 34 into housing 12 and oil sump 44 so that pistons 38 move substantially in an intake gas environment. By separating running gear cavity 34 from the oil in the oil sump 44 in accordance with the invention as described previously herein, the rotating and moving parts are baffled and isolated from the oil. Hence, the additional power loss from parts moving within the oil is eliminated.

Alternatively, the oil baffle of the present invention may be cast together with the outboard bearing or crankcase thereby eliminating additional parts.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains an which fall within the limits of the appended claims.

What is claimed is:

1. A hermetic reciprocating compressor comprising:

a housing containing an oil sump;

a crankcase, disposed in said oil sump, said crankcase defining a running gear cavity at equal pressure with and directly open to said housing, said crankcase containing at least one cylinder with a reciprocating piston therein, said cavity containing crank means for reciprocating said piston, said cavity in communication with said cylinder;

a motor drivingly connected to said crank means; and oil baffle means comprising a flange having a vertical portion, said oil baffle means attached to said crankcase to separate said running gear cavity from said oil sump for preventing oil from being repetitively drawn into and from said cylinder, said running gear cavity communicating with the interior of said housing over said baffle means.

2. The compressor of claim 1 in which said oil baffle means further comprises a biasing means for biasing said vertical portion into engagement with said crankcase.

3. The compressor of claim 2 in which said biasing means comprises at least two stiffening ribs on said vertical portion whereby said vertical portion may be tightly engaged to said crankcase by spring forces developed by said ribs.

4. The compressor of claim 3 in which said vertical portion further has a dimple to increase the spring force developed by said ribs.

5. The compressor of claim 1 in which said crank means has an outboard bearing, said oil baffle means creating an oil tight seal with said crankcase and said outboard bearing.

6. A hermetic reciprocating compressor comprising:

a housing containing an oil sump;

a crankcase disposed in said housing and defining a running gear cavity at equal pressure to and directly open to said housing, said crankcase containing at least one cylinder with a reciprocating piston therein, said cavity containing crank means for reciprocating said piston, said crank means having an outboard bearing located within said oil sump;

a motor drivingly connected to said crank means; and an oil baffle comprising a flange having a vertical portion, said oil baffle attached to said crankcase and said outboard bearing to separate said running gear cavity from said oil sump, said running gear cavity in communication with the interior of said housing over said baffle whereby during compressor startup, reciprocation of said piston will drive oil collected in said cavity into said sump therefore said piston moves in a substantially gas environment.

7. The compressor of claim 6 in which said oil baffle further comprises said vertical part having at least two stiffening ribs, whereby said vertical part is tightly fixed to said crankcase by spring forces developed by said ribs.

8. The compressor of claim 7 in which said vertical part further comprises a central dimple to increase said spring forces developed by said ribs.

9. The compressor of claim 6 in which said oil baffle creates an oil tight seal with said crankcase and said outboard bearing.

10. A hermetic reciprocating compressor comprising:

a housing containing an oil sump;

a crankcase, disposed in said housing, partially in said oil sump, said crankcase defining a running gear cavity, said crankcase containing at least one cylinder with a reciprocating piston therein, said cavity containing crank means for reciprocating said piston, said crank means having an outboard bearing;

a motor drivingly connected to said crank means; and an oil baffle comprising a flange having a vertical part, said vertical part having at least two stiffening ribs and a dimple to permit said vertical part to be tightly fixed to said crankcase by spring forces developed by said ribs and said dimple on attachment to said outboard bearing, said baffle attached to said outboard bearing to separate said crank means from said oil sump, whereby compressor startup, reciprocation of said piston will drive oil collected in said cavity into said sump so said piston and said crank means moves in a substantially gas environment.

11. The compressor of claim 10 in which said oil baffle creates an oil tight seal with said crankcase and said outboard bearing.

* * * * *

UNITED STATES PATENT AND TRADEMARK OFFICE

CERTIFICATE OF CORRECTION

PATENT NO. : 5,281,110

DATED : January 25, 1994

INVENTOR(S) : Nelik I. Dreiman

It is certified that error appears in the above-identified patent and that said Letters Patent is hereby corrected as shown below:

Claim 10, column 6, line 28, after "whereby" insert --during--.

Signed and Sealed this

Thirty-first Day of May, 1994

Bruce Lehman

*Attest:*

BRUCE LEHMAN

*Attesting Officer*

*Commissioner of Patents and Trademarks*